United States Patent [19]

Klebanoff

[11] Patent Number: 4,524,678

[45] Date of Patent: Jun. 25, 1985

[54] DAMPER WITH INTEGRAL SUPPORT

[75] Inventor: Steven L. Klebanoff, Westchester County, N.Y.

[73] Assignee: Ruskin Manufacturing Company, Grandview, Mo.

[21] Appl. No.: 447,470

[22] Filed: Dec. 6, 1982

[51] Int. Cl.[3] ..... F24F 11/00

[52] U.S. Cl. ..... 98/1; 285/64

[58] Field of Search ..... 98/1, 40 R, 40 B, 40 D, 98/41, 101, 118; 248/DIG. 6; 285/64, 192, 424; 29/509, 513; 52/220, 221, 232, 360, 712, 713, 715

[56] References Cited

U.S. PATENT DOCUMENTS

| | | | |
|---|---|---|---|
| 1,612,075 | 12/1926 | Tapman, Jr. | 52/712 |
| 1,780,406 | 11/1930 | Siebenlist | 52/360 |
| 3,347,569 | 10/1967 | Lindgren | 285/64 |
| 3,712,649 | 1/1973 | Martin | 285/424 X |
| 3,727,663 | 4/1973 | McCabe | 285/424 X |
| 3,985,158 | 10/1976 | Felter | 98/40 D X |

OTHER PUBLICATIONS

"The Home of Comfort Air Distribution Systems", *Char-Gale,* Char-Gale Manufacturing Co., Anoka, MN, Jan. 1957, pp. 40 and 41.

"Steel Switch and Outlet Boxes", *Pitt Line,* Illustrated Catalog 177-R, The Pitt Manufacturing Co., Carnegie, PA, Jan. 1977.

*Primary Examiner*—Harold Joyce

*Attorney, Agent, or Firm*—Kokjer, Kircher, Bradley, Wharton, Bowman & Johnson

[57] ABSTRACT

Attaching structure to secure a fire damper in proper position in a fluid passage in a fire wall comprising an elongated bendable strap of sheet material secured to the damper frame on each side of the damper. The frame is inserted in the passage by the installing workmen and the projecting legs are then bent from their initial positions lying flat against the exterior surface of the damper frame and into embracing relationship with the building studs defining the passage opening. The bent legs of the strap securely anchor the damper in position against forces applied to the damper.

1 Claim, 3 Drawing Figures

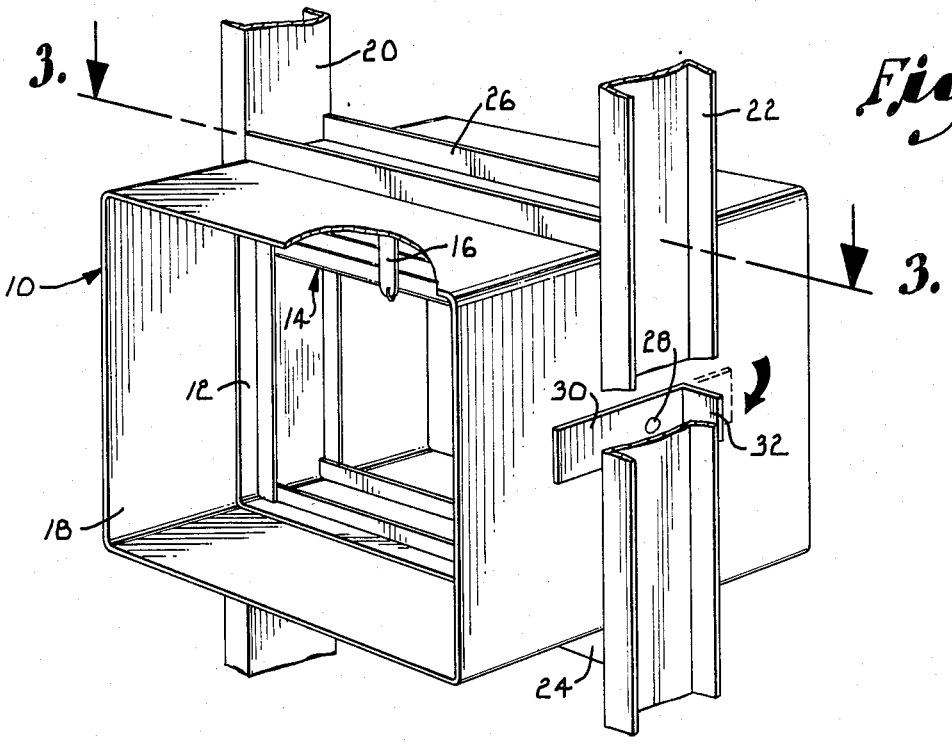
Fig. 1.
Fig. 2.
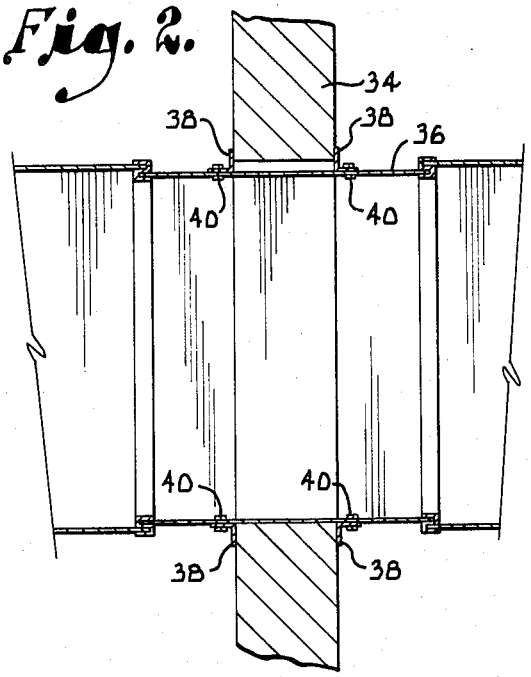
PRIOR ART
Fig. 3.
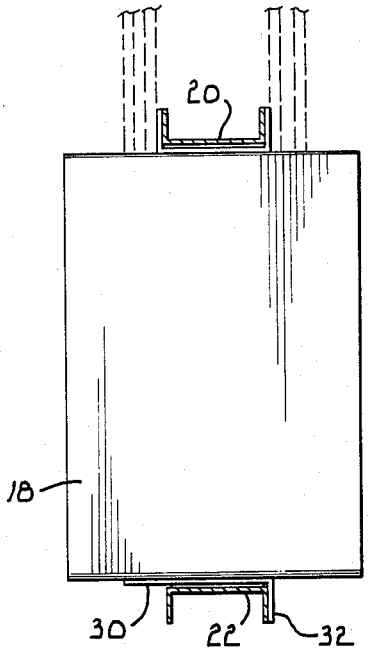

DAMPER WITH INTEGRAL SUPPORT

This invention pertains to fire and smoke dampers and a method of installation thereof. Dampers of this type are commonly installed in fluid passages in buildings such as in heating and air conditioning ducts to interrupt the flow of fluid through the passages in the event of fire in the building. Such dampers often comprise a peripheral frame on which is mounted a barrier movable between open and closed positions. The barrier is normally held in the open or standby position by a retaining device including a fusible link. Durable springs bias the barrier toward its closed position and when the temperature is elevated to a predetermined critical value, the link gives way to permit the springs to close the damper.

Protective devices of this type are required to pass rigid industry standard tests in order to insure reliable functioning in case of fire. The purpose of such devices is to provide protection for lives and property when a fire breaks out and they must be capable of sealing off strategic fluid communication ports, even when subjected to the rigors which can be expected in the combustion area. It is common for engineers and architects to specify certain testing laboratory certification for such devices as a prerequisite to their incorporation into building construction. Similar requirements are also often included in applicable building and construction codes.

One particularly rigid requirement that has heretofore figured materially in the relatively high costs for the installation of fire and smoke dampers has been the requirement that the devices be installed in a manner to withstand a stream of water at high pressure directed against the damper without such stream dislodging the damper from its installed position. It is reasonable to assume that such a stream from a fire hose might be encountered by a damper in case of fire. It has heretofore been considered that the only practical way to install such a damper so that it possessed the required strength against dislodgement from such forces was to secure the damper with prefabricated, steel angle members attached to the damper and abutting the adjacent wall. Since dampers are normally telescoped through a wall opening, such construction required that the angle members be separately installed on the damper by workmen after the damper had been adjusted into its proper position extending through the wall.

While installations of this type are durable enough, they have required a substantial amount of time resulting in increases in overall construction costs. None of the economies available from assembly line, high speed production techniques are attainable for attachment of such separate mounting angles to the dampers by workmen in the field. Further, the fabrication of the angle brackets as separate items is not insubstantial.

Accordingly, it is a primary object of the instant invention to provide a method and structure for quickly and easily securing protective dampers in building construction.

It is another important object of the invention to provide structure and a method for economically securing such dampers in a manner which affords the strength at the installation necessary to meet all relevant industry standards.

Still another object of the present invention is to provide means for securing the damper in place which means may be prefabricated directly on the damper, thereby securing the economies available through mass production techniques.

Still another object of the invention is to provide such means which can be readily used by ordinary workmen in the field without the need for other than ordinary, readily available equipment and tools.

These and other important aims and objectives of the present invention will be further explained or will be readily understood from the following explanation and description of the drawing, wherein:

FIG. 1 is a front perspective view of a damper incorporating the principles of this invention and shown in a typical installation, the original position of one tab of the proximal element being shown in dash lines, adjacent building construction members appearing fragmentally;

FIG. 2 is a fragmentary, horizontal cross-sectional view showing a typical prior art damper installation; and FIG. 3 is a vertical, cross-sectional view taken along line 3—3 of FIG. 1.

A damper embodying the principles of this invention is broadly designated by the reference numeral 10 and includes a peripheral frame 12 and a barrier 14 mounted to frame 12 and adapted to move across the opening defined by the frame to block the flow of fluid through the damper opening. Barrier 14, which may be in the nature of a screen comprised of a plurality of pivotally interconnected blades, is held in its standby position by a fusible link 16. Link 16 is constructed of euctectic material having the property of melting when the ambient temperature reaches a predetermined critical level whereupon barrier 14 is permitted to move under the influence of springs (not shown) across the damper opening to terminate the fluid flow through the damper.

Integral with frame 12 and comprising a part thereof is an elongated, peripherially extending collar 18 configured to mate with the building heating and air conditioning ducts for conducting fluid through the damper opening. Collar 18 is of a shape to be received within a fluid passage provided in the construction of the building.

Framing members defining the fluid passage constructed in a building wall include vertically extending, spaced apart parallel studs or members 20 and 22 forming the passage sides. A horizontal member 24 interconnects studs 20 and 22 and provides the lower support for the damper. A generally horizontal top member 26 extends in spaced apart parallelism with member 24 above the latter to complete the periphery of the fluid passage in the building wall into which damper 10 is interposed for fire control purposes.

A principle feature of this invention is the provision on each side of frame 12, and more particularly on the exterior side surfaces of collar 18, of an elongated strip of material secured to the collar by means such as a fastener 28. The strip of material preferably is in the nature of a strap 30 of sheet steel or the like. Fastener 28 may be in the nature of a bolt, screw or a spot weld or the like, and the fastener rigidly secures strap 30 to the collar.

Strap 30 is preferably applied to the collar during the fabrication of the damper unit so that the damper can be quickly and easily inserted into the wall fluid passage during construction of the building. Once the damper is installed in its proper position, the installing workmen may simply bend strap 30, as indicated generally by the arrow in FIG. 1, so that legs 32 bent from the strap embrace each side of the adjacent support member to securely lock the damper in its proper position. The sheet material of the strap is of such nature to permit the legs 32 to be readily bent by a workmen, yet the legs will not readily bend from the embracing configuration around the support member under forces exerted against the damper barrier such as the forces which are encountered from high pressure water hoses or the like.

Each strap 30 on each side of the damper collar is bent in similar fashion so that both sides of the collar are secured in place. FIG. 3 of the drawing illustrates generally how the straps secure the damper collar in its position and also illustrate in dash lines how the construction of the fire wall may be completed following installation of the damper.

FIG. 2 of the drawing illustrates generally the conventional manner heretofore utilized in securing fire dampers in a fire wall 34. The collar 36 was inserted through the fluid passage and preformed angles 38 were installed by fasteners 40 at each of the four corner junctions between the collar and the wall. This procedure not only required the separate assembly of individual components at the building site but was also time consuming and expensive. The construction pursuant to the principles of this invention illustrated in FIGS. 1 and 3 of the drawing obviate the need for awkward and expensive separate anchoring angles and greatly reduce the expense of damper installation without detracting from the secure positioning of the damper to satisfy the requirements imposed by industry standards.

I claim:

1. A prefabricated protective damper to be secured in a postion for blocking flow through a building passageway defined by a pair of generally parallel, spaced apart, longitudinally extending construction members, there being a member at each side of said passageway, said damper including:

a rigid, peripherally extending, rectangular frame defining a damper opening, said frame having a pair of substantially parallel sides having generally flat outer surfaces;

automatically actuatable means mounted on the frame for blocking fluid flow through the damper opening responsvie to elevation of the ambient temperature beyond a predetemined limit; and a pair of elongated, bendable straps of flat sheet steel material, said respective straps being secured intermediate the ends thereof to opposite sides of the frame and lying flat against the respective surface to minimize the space required for the damper prior to installation, the free ends of each strap being bendable away from the damper side surface into embracing relationship with a corresponding proximal construction member to quickly and easily secure the damper in fixed position across said passageway and against dislodgement from said position under the influence of substantial fluid forces against the damper.

* * * * *